US009217405B2

(12) United States Patent
Surnilla et al.

(10) Patent No.: US 9,217,405 B2
(45) Date of Patent: Dec. 22, 2015

(54) SYSTEM AND METHOD FOR LUBRICATING A FUEL PUMP

(75) Inventors: Gopichandra Surnilla, West Bloomfield, MI (US); Joseph Basmaji, Waterford, MI (US); Ross Dykstra Pursifull, Dearborn, MI (US); Larry Dean Elie, Ypsilanti, MI (US); Richard E. Soltis, Saline, MI (US); David Karl Bidner, Livonia, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 992 days.

(21) Appl. No.: 13/166,572

(22) Filed: Jun. 22, 2011

(65) Prior Publication Data

US 2012/0328452 A1 Dec. 27, 2012

(51) Int. Cl.

| | |
|---|---|
| ***F02M 57/02*** | (2006.01) |
| ***F02M 59/10*** | (2006.01) |
| ***F02M 37/00*** | (2006.01) |
| ***F02M 63/00*** | (2006.01) |
| ***F02M 43/00*** | (2006.01) |
| ***F02M 43/02*** | (2006.01) |
| ***F02D 41/12*** | (2006.01) |
| *F02D 41/22* | (2006.01) |

(52) U.S. Cl.

CPC ..... *F02M 57/023* (2013.01); *F02D 41/123* (2013.01); *F02M 37/0052* (2013.01); *F02M 37/0064* (2013.01); *F02M 43/00* (2013.01); *F02M 43/02* (2013.01); *F02M 59/102* (2013.01); *F02M 63/0001* (2013.01); *F02D 41/221* (2013.01); *F02D 2041/226* (2013.01)

(58) Field of Classification Search

CPC .. F01B 31/12; F02M 59/102; F02M 37/0052; F02M 37/0064; F02M 57/023; F02D 2041/224; F04B 13/07; F04B 17/05; F04B 2201/0205; F04B 2201/0208; F04B 2205/09; F04B 2205/14; F04B 2205/50; F04B 2205/501; F16K 37/0083

USPC ..... 417/43, 44.11, 63, 53, 213; 92/5 R; 123/495, 497, 461, 506, 508–510, 123/198 D, 304, 575; 184/27.1, 27.2, 37; 73/114.43, 114.56, 168

See application file for complete search history.

(56) References Cited

U.S. PATENT DOCUMENTS

| | | | | |
|---|---|---|---|---|
| 4,915,084 | A * | 4/1990 | Gonze | 123/575 |
| 5,179,926 | A * | 1/1993 | Ament | 123/494 |
| 5,216,409 | A * | 6/1993 | Ament et al. | 340/438 |

(Continued)

OTHER PUBLICATIONS

Crane, TP-410. "Chapter 5—Pumping Fluid Through Piping Systems." Flow of Fluids Through Valves, Fittings and Pipe. Stamford: Crane, 2013. 5-1+. Print.pp. 5-1 and 5-5 only.*

(Continued)

*Primary Examiner* — Devon Kramer
*Assistant Examiner* — Joseph Herrmann
(74) *Attorney, Agent, or Firm* — Julia Voutyras; Alleman Hall McCoy Russell & Tuttle LLP

(57) ABSTRACT

Systems and methods for diagnosing and operating an engine with a fuel pump that supplies fuel to a fuel injector that may be temporarily deactivated are described. In one example, injection of fuel may commence in response to a level of lubrication of a fuel pump. The system and methods may extend fuel pump life in systems where fuel injection may be deactivated.

14 Claims, 8 Drawing Sheets

(56) References Cited

U.S. PATENT DOCUMENTS

| | | | | |
|---|---|---|---|---|
| 5,245,953 | A * | 9/1993 | Shimada et al. | 123/25 E |
| 5,394,844 | A | 3/1995 | Akimoto | |
| 5,770,796 | A | 6/1998 | Sakamoto et al. | |
| 6,742,479 | B2 | 6/2004 | Yanagisawa | |
| 6,860,255 | B2 * | 3/2005 | Yamaguchi et al. | 123/495 |
| 6,880,528 | B2 | 4/2005 | Klügl et al. | |
| 2003/0089343 | A1 | 5/2003 | Yamaguchi et al. | |
| 2010/0082223 | A1 * | 4/2010 | Toyohara et al. | 701/103 |

OTHER PUBLICATIONS

Partial Translation of Office Action of Chinese Application No. 2012102139999, Issued Sep. 6, 2015, State Intellectual Property Office of PRC, 8 Pages.

* cited by examiner

SYSTEM AND METHOD FOR LUBRICATING A FUEL PUMP

FIELD

The present description relates to systems and methods for diagnosing and lubricating a fuel pump. The system and method may be particularly useful for systems that temporarily deactivate injection of fuel during engine operation.

BACKGROUND AND SUMMARY

An engine may be operated with a fuel injection system that is temporarily deactivated in response to engine operating conditions. The fuel injection system may be deactivated to reduce energy consumption of a vehicle. For example, fuel injection may be temporarily deactivated during vehicle deceleration when engine torque may not be needed. Further, in engine systems that include two or more fuel injection systems, one fuel injection system may be temporarily deactivated while the other injection system continues to deliver fuel to the engine. By deactivating one fuel injection system, it may be possible to reduce energy consumption of the vehicle. However, if components of a fuel pump of the fuel injection system continue to move while the fuel injection system is deactivated, performance of the fuel pump may degrade over time.

The inventors herein have recognized the above-mentioned disadvantages and have developed a method for operating a fuel pump, comprising: diagnosing operation of a fuel pump driven solely mechanically in response to an electrical property between a motive force component of the fuel pump and a stationary component of the fuel pump.

By assessing an electrical property of a mechanically driven pump it may be possible to determine whether or not the mechanically driven pump is degraded and/or is being lubricated during times where flow through the mechanically driven fuel pump is low. An electrical property between two components of a fuel pump can be an indication of pump degradation and lubrication. Thus, the electrical property can be a basis for diagnosing and controlling flow through the fuel pump. For example, some fuel pumps include a piston that provides pressure to fuel passing through the fuel pump. The piston may be constrained via a fuel pump housing or cylinder within which the piston moves. An electrical resistance or capacitance between the piston and the housing or cylinder may be a basis for determining fuel pump degradation and whether or not the fuel pump is being lubricated when flow through the fuel pump is low. If the electrical resistance of the fuel pump is low, it may be an indication that there is little fuel between the piston and the cylinder wall providing lubrication to the fuel pump. Fuel pump lubrication may be increased to limit fuel pump degradation by increasing fuel flow through the fuel pump in response to the low electrical resistance level.

The present description may provide several advantages. In particular, the approach may provide for an increased level of lubrication between moving parts of a fuel pump so as to reduce fuel pump degradation. In addition, the approach may help to conserve fuel since the fuel pump can be operated at higher pumping capacities only when scheduled by engine operating conditions or when a low level of pump lubrication is indicated. Further still, the present description provides for diagnosing a fuel pump in response to an electrical property of the fuel pump.

The above advantages and other advantages, and features of the present description will be readily apparent from the following Detailed Description when taken alone or in connection with the accompanying drawings.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE DRAWINGS

The advantages described herein will be more fully understood by reading an example of an embodiment, referred to herein as the Detailed Description, when taken alone or with reference to the drawings, wherein.

DETAILED DESCRIPTION

Figure 1:
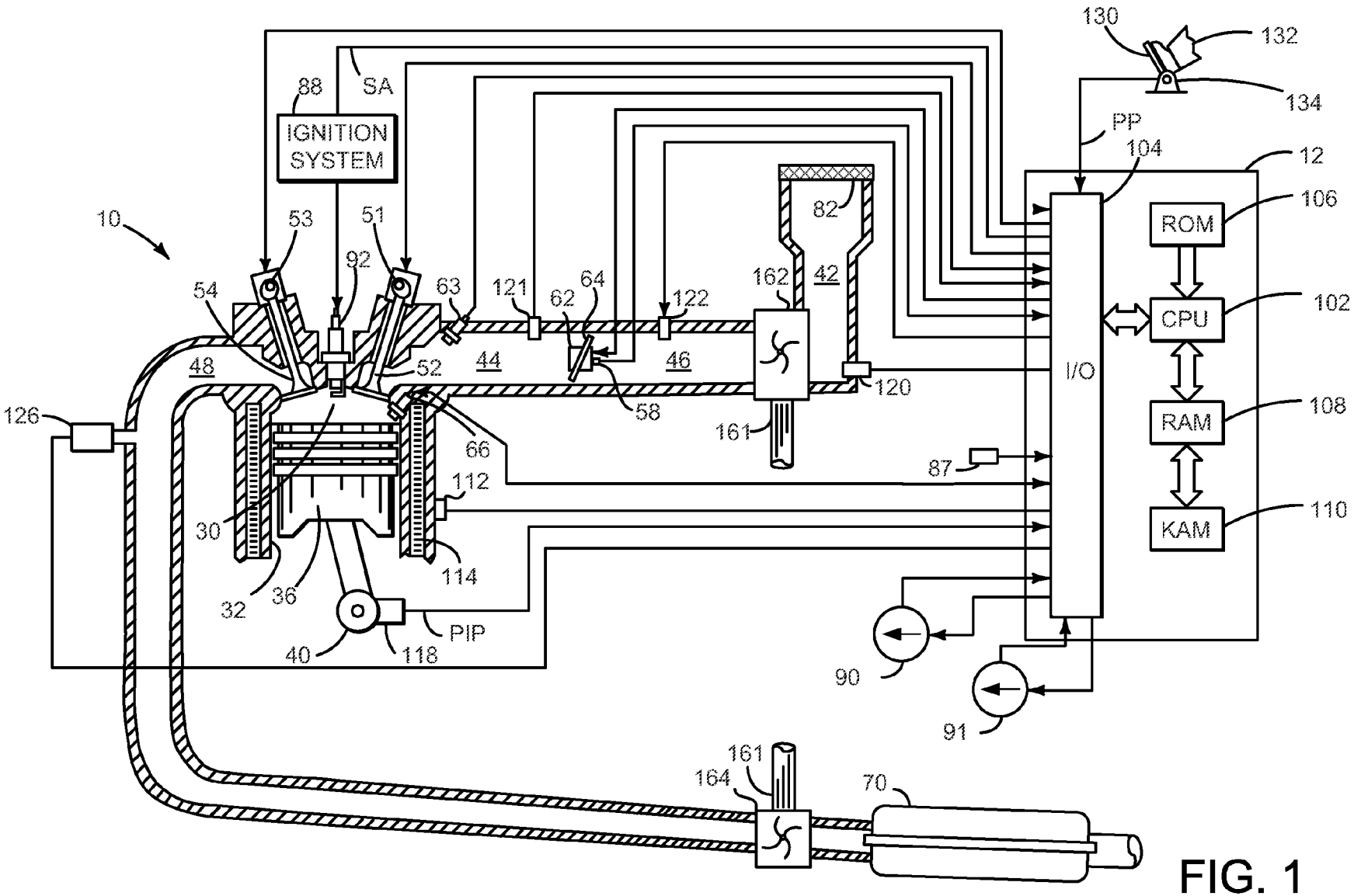
FIG. 1 is a schematic diagram of an engine.

The present description is related to operating a fuel pump of an engine. In one example, the fuel pump is a high pressure fuel pump driven by the engine supplying fuel directly to engine cylinders as illustrated in FIG. 1. FIGS. 2-7 show a few example fuel injection systems. The fuel pump may be a piston pump as shown in FIG. 8A or an alternative pump design, one of which is shown in the example of FIG. 8B. The fuel pump may be operated according to the method of FIGS. 9-11 via the controller shown in FIG. 1.

Referring to FIG. 1, internal combustion engine 10, comprising a plurality of cylinders, one cylinder of which is shown in FIG. 1, is controlled by electronic engine controller 12. Engine 10 includes combustion chamber 30 and cylinder walls 32 with piston 36 positioned therein and connected to crankshaft 40. Combustion chamber 30 is shown communicating with intake manifold 44 and exhaust manifold 48 via respective intake valve 52 and exhaust valve 54. Each intake and exhaust valve may be operated by an intake cam 51 and an exhaust cam 53. Alternatively, one or more of the intake and exhaust valves may be operated by an electromechanically controlled valve coil and armature assembly.

Intake manifold 44 is also shown coupled to the engine cylinder having fuel injector 63 coupled thereto for delivering liquid fuel in proportion to a pulse width from controller 12. Fuel can also be injected to combustion chamber 30 via direct injector 66. In alternative examples, injectors 63 and 66 may both be direct fuel injectors. Fuel is delivered to fuel injectors 63 and 66 by a fuel system including fuel tanks as shown in FIGS. 2-7. Fuel pumps 90 and 91 supply fuel to fuel injector 66 and 63. Fuel pumps 63 and 66 may be activated and deactivated via commands from controller 12. Controller 12 includes circuitry for measuring the electrical resistance and capacitance of one or both fuel pumps 90 and 91.

Intake manifold 44 is shown communicating with intake plenum 42 via optional electronic throttle 62 and boost chamber 46. Throttle plate 64 controls the flow of air through electronic throttle 62 from boost chamber 46. Boost chamber 46 may hold pressurized air from turbocharger compressor 162. Air filter 82 filters air entering intake plenum 42.

Turbocharger compressor 162 compresses air from intake plenum 42 and is driven by turbine 164 via shaft 161. Exhaust gases exit combustion chamber 30 and impart force to rotate turbine 164. In this way, additional air may be provided to engine 10 to increase engine power output.

Distributorless ignition system 88 provides an ignition spark to combustion chamber 30 via spark plug 92 in response to controller 12. Universal Exhaust Gas Oxygen (UEGO) sensor 126 is shown coupled to exhaust manifold 48 upstream of catalytic converter 70. Alternatively, a two-state exhaust gas oxygen sensor may be substituted for UEGO sensor 126.

Converter 70 can include multiple catalyst bricks, in one example. In another example, multiple emission control devices, each with multiple bricks, can be used. Converter 70 can be a three-way type catalyst in one example.

Controller 12 is shown in FIG. 1 as a conventional microcomputer including: microprocessor unit 102, input/output ports 104, read-only memory 106, random access memory 108, keep alive memory 110, and a conventional data bus. Controller 12 is shown receiving various signals from sensors coupled to engine 10, in addition to those signals previously discussed, including: engine coolant temperature (ECT) from temperature sensor 112 coupled to cooling sleeve 114; a position sensor 134 coupled to an accelerator pedal 130 for sensing force applied by foot 132; a measurement of engine manifold pressure (MAP) from pressure sensor 121 coupled to intake manifold 44; an engine position sensor from a Hall effect sensor 118 sensing crankshaft 40 position; a measurement of boost pressure from pressure sensor 122; a measurement of air mass entering the engine from sensor 120; and a measurement of throttle position from sensor 58. Barometric pressure may also be sensed via barometric pressure sensor 87. In a preferred aspect of the present description, engine position sensor 118 produces a predetermined number of equally spaced pulses every revolution of the crankshaft from which engine speed (RPM) can be determined.

In some embodiments, the engine may be coupled to an electric motor/battery system in a hybrid vehicle. The hybrid vehicle may have a parallel configuration, series configuration, or variation or combinations thereof.

During operation, each cylinder within engine 10 typically undergoes a four stroke cycle: the cycle includes the intake stroke, compression stroke, expansion stroke, and exhaust stroke. During the intake stroke, generally, the exhaust valve 54 closes and intake valve 52 opens. Air is introduced into combustion chamber 30 via intake manifold 44, and piston 36 moves to the bottom of the cylinder so as to increase the volume within combustion chamber 30. The position at which piston 36 is near the bottom of the cylinder and at the end of its stroke (e.g. when combustion chamber 30 is at its largest volume) is typically referred to by those of skill in the art as bottom dead center (BDC). During the compression stroke, intake valve 52 and exhaust valve 54 are closed. Piston 36 moves toward the cylinder head so as to compress the air within combustion chamber 30. The point at which piston 36 is at the end of its stroke and closest to the cylinder head (e.g. when combustion chamber 30 is at its smallest volume) is typically referred to by those of skill in the art as top dead center (TDC). In a process hereinafter referred to as injection, fuel is introduced into the combustion chamber. In a process hereinafter referred to as ignition, the injected fuel is ignited by known ignition means such as spark plug 92, resulting in combustion. During the expansion stroke, the expanding gases push piston 36 back to BDC. Crankshaft 40 converts piston movement into a rotational torque of the crankshaft. Finally, during the exhaust stroke, the exhaust valve 54 opens to release the combusted air-fuel mixture to exhaust manifold 48 and the piston returns to TDC. Note that the above is shown merely as an example, and that intake and exhaust valve opening and/or closing timings may vary, such as to provide positive or negative valve overlap, late intake valve closing, or various other examples.

Figure 2:
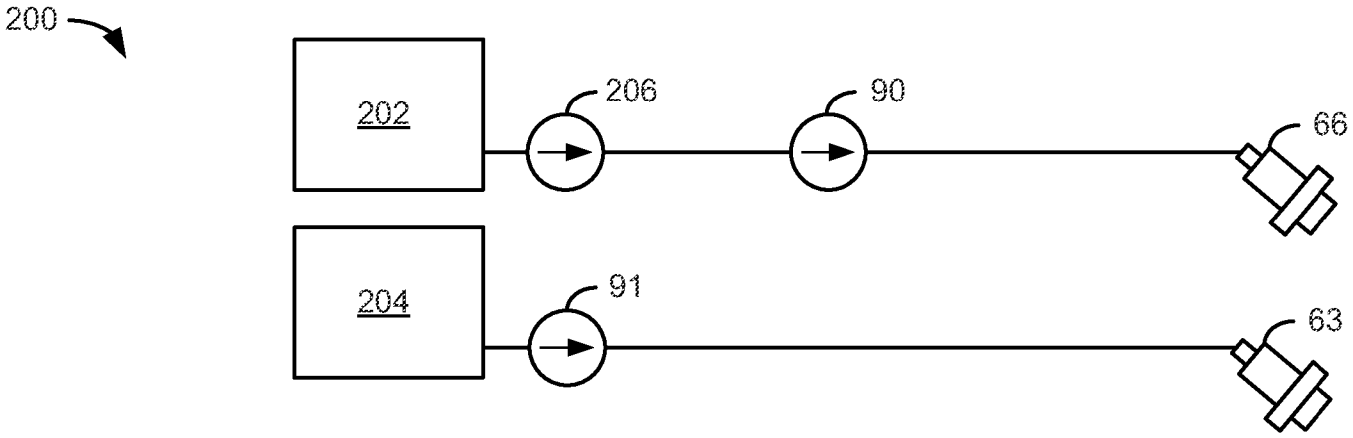
FIG. 2 is a schematic of an example fuel system supplying fuel to an engine.

Referring to FIG. 2, a schematic of an example fuel system supplying fuel to an engine is shown. The fuel system of FIG. 2 may be incorporated with the system of FIG. 1 to supply fuel to the engine of FIG. 1. Components of FIG. 2 may be operated via the method of FIG. 9.

Fuel system 200 includes a first fuel tank 202 holding a first fuel type (e.g., alcohol). Fuel is drawn from fuel tank 202 via fuel pump 206. In one example, fuel pump 206 may be an electrically driven fuel pump. Fuel pump 206 may be a lower pressure fuel pump. Fuel pump 206 supplies fuel to fuel pump 90. In one example, fuel pump 90 is mechanically driven via an engine (e.g., engine 10 of FIG. 1). Fuel pump 90 may be driven via a camshaft or a crankshaft. Fuel pump 90 supplies fuel to direct injector 66 at a higher pressure than fuel pumped from fuel pump 206. Fuel flow through fuel pump 90 may be adjusted or regulated via opening and closing fuel injector 66.

Second fuel tank 204 holds a second fuel type (e.g., gasoline). Fuel is drawn from fuel tank 204 via fuel pump 91. Fuel pump 91 may be electrically driven and supplies fuel to fuel injector 63. Fuel injector 63 and fuel injector 66 may be operated independently and according to the methods described in U.S. Pat. No. 7,426,925 which is hereby fully incorporated by reference for all intents and purposes. In alternative examples, fuel tank 204, fuel pump 91, and fuel injector 63 may be eliminated so that the engine operates only with direct fuel injection.

Although FIG. 2 shows a fuel pump for delivering fuel to an engine, it should be understood that the methods and concepts described herein may also be applicable to alternative pump designs supplying different types of fluids to different apparatuses. For example, a mechanically driven pump may supply oil to provide hydraulic power to lift and/or move objects. If the pump continues to move while supplying little oil to the oil consumer, an electrical property of the pump may be the basis for controlling flow though the pump.

Figure 3:
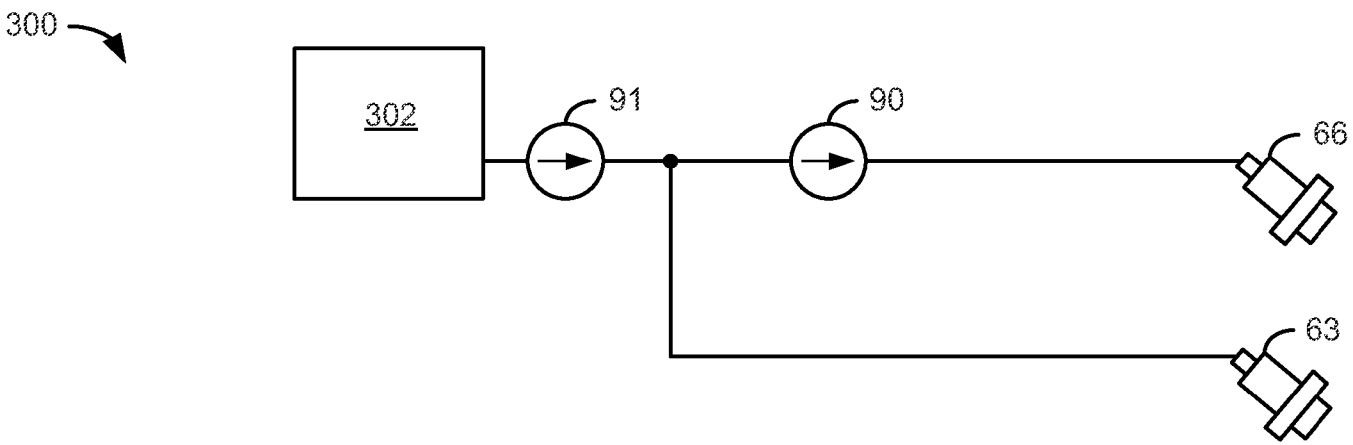
FIG. 3 is a schematic of an alternative example fuel system supplying fuel to an engine.

Referring now to FIG. 3, a schematic of an alternative example fuel system supplying fuel to an engine is shown. The fuel system of FIG. 3 may be incorporated with the system of FIG. 1 to supply fuel to the engine of FIG. 1. Components of FIG. 3 may be operated via the method of FIGS. 9-11.

Fuel system 300 includes a single fuel tank 302 holding a fuel (e.g., gasoline and/or alcohol). Fuel is drawn from fuel tank 302 via fuel pump 91. In one example, fuel pump 91 may be an electrically driven fuel pump. Fuel pump 91 may be a lower pressure fuel pump. Fuel pump 91 supplies fuel to fuel pump 90. In one example, fuel pump 90 is mechanically driven via an engine (e.g., engine 10 of FIG. 1). Fuel pump 90 may be driven via a camshaft or a crankshaft. Fuel pump 90 supplies fuel to direct injector 66 at a higher pressure than fuel pumped from fuel pump 91. Fuel flow through fuel pump 90 may be adjusted or regulated via opening and closing fuel injector 66.

Fuel pump 91 also supplies fuel directly to second fuel injector 63 absent a second inline fuel pump. Fuel injector 63 and fuel injector 66 may be operated independently. Fuel injector 63 may supply fuel during engine starting while fuel injector 66 provides fuel to the engine after engine starting.

Figure 4:
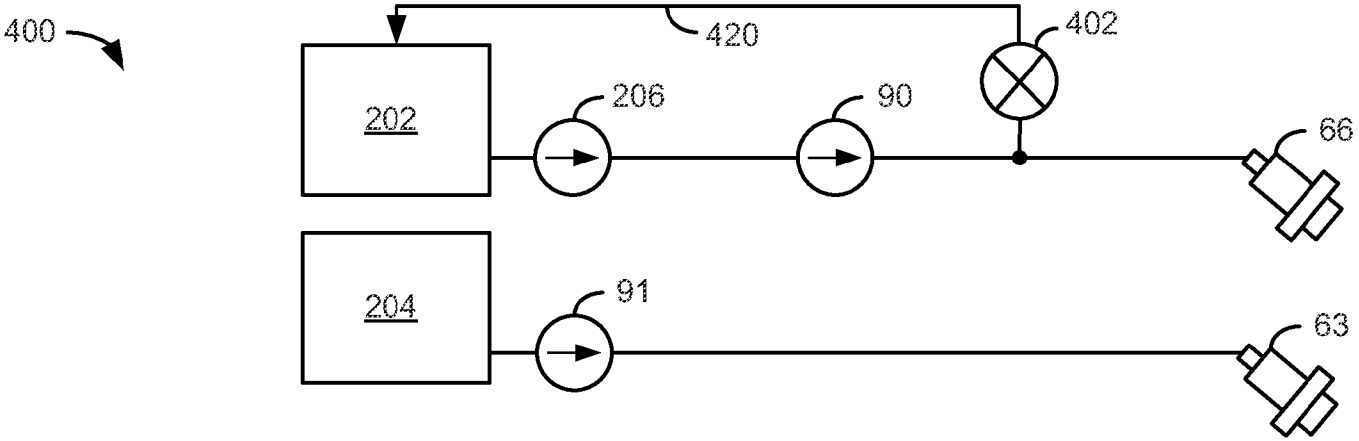
FIG. 4 is a schematic of another alternative example fuel system supplying fuel to an engine.

Referring now to FIG. 4, a schematic of another alternative example fuel system supplying fuel to an engine is shown. The fuel system of FIG. 4 may be incorporated with the system of FIG. 1 to supply fuel to the engine of FIG. 1. Components of FIG. 4 may be operated via the method of FIGS. 9-11.

Fuel system 400 is identical to fuel system 200 except fuel system 400 includes a fuel return valve 402 that returns fuel back to fuel tank 202 when opened. The components of fuel system 400 common with components of fuel system 200 are numbered the same and operated as described in FIG. 2. Therefore, for the sake of brevity, the description of these components is omitted here and only new elements or components are described.

When return valve 402 is open, fuel can flow from the outlet of fuel pump 90 in the direction of the arrow of return line 420. Thus, valve 402 or fuel injector 66 can control the flow of fuel through fuel pump 90. Valve 402 allows fuel to flow through and lubricate pump 90 without having to operate fuel injector 66. Consequently, fuel injector operation does not have to be adjusted in system 400 in order to lubricate fuel pump 90.

Thus, fuel pump lubrication does not have come from that condition of fuel passing through the fuel pump. Rather, fuel pump lubrication can be a result of fuel being forced between the piston and the fuel pump housing bore interface. In such conditions, fuel can be circulated at a pressure to increase fuel pump lubrication.

Figure 5:
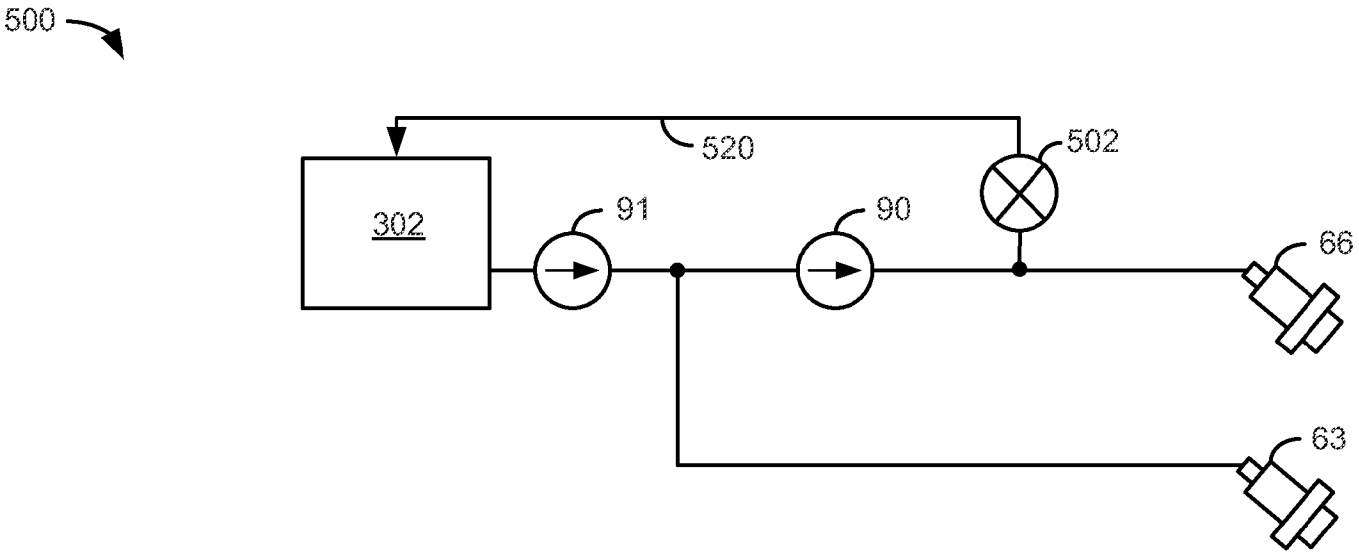
FIG. 5 is a schematic of another alternative example fuel system supplying fuel to an engine.

Referring now to FIG. 5, a schematic of another alternative example fuel system supplying fuel to an engine is shown. The fuel system of FIG. 5 may be incorporated with the system of FIG. 1 to supply fuel to the engine of FIG. 1. Components of FIG. 5 may be operated via the method of FIGS. 9-11.

Fuel system 500 is identical to fuel system 300 except fuel system 500 includes a fuel return valve 502 that returns fuel back to fuel tank 302 when opened. The components of fuel system 500 common with components of fuel system 300 are numbered the same and operated as described in FIG. 3. Therefore, for the sake of brevity, the description of these components is omitted here and only new elements or components are described.

When return valve 502 is open, fuel can flow from the outlet of fuel pump 90 in the direction of the arrow of return line 520. Thus, valve 502 or fuel injector 66 can control the flow of fuel through fuel pump 90. Valve 502 allows fuel to flow through and lubricate fuel pump 90 without having to operate fuel injector 66. Consequently, fuel injector operation does not have to be adjusted in system 500 in order to lubricate fuel pump 90.

Figure 6:
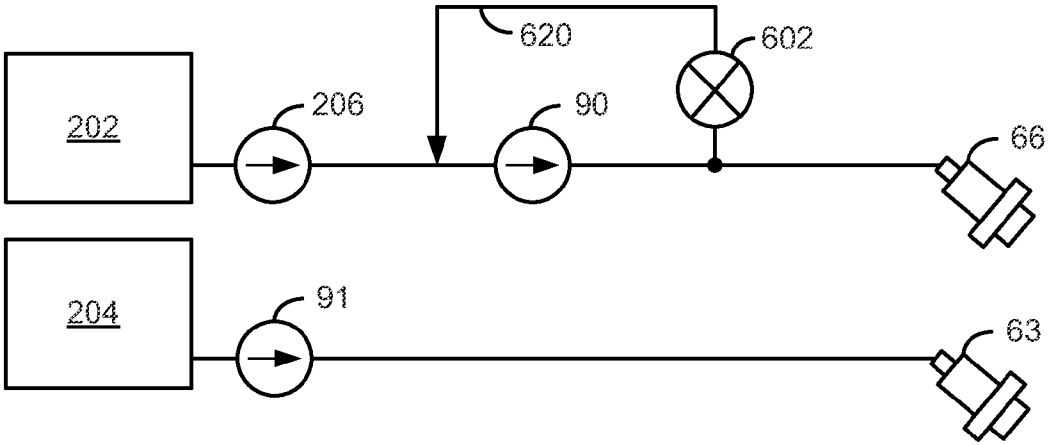
FIG. 6 is a schematic of another alternative example fuel system supplying fuel to an engine.

Referring now to FIG. 6, a schematic of another alternative example fuel system supplying fuel to an engine is shown. The fuel system of FIG. 6 may be incorporated with the system of FIG. 1 to supply fuel to the engine of FIG. 1. Components of FIG. 6 may be operated via the method of FIGS. 9-11.

Fuel system 600 is identical to fuel system 200 except fuel system 600 includes a fuel return valve 602 that returns fuel back to the inlet of fuel pump 90 when opened. The components of fuel system 600 common with components of fuel system 200 are numbered the same and operated as described in FIG. 2. Therefore, for the sake of brevity, the description of these components is omitted here and only new elements or components are described.

When bypass valve 602 is open, fuel can flow from the outlet of fuel pump 90 in the direction of the arrow of bypass line 620. Thus, valve 602 or fuel injector 66 can control the flow of fuel through fuel pump 90. Valve 602 allows fuel to flow through and lubricate pump 90 without having to operate fuel injector 66. Consequently, fuel injector operation does not have to be adjusted in system 600 in order to lubricate fuel pump 90.

Figure 7:
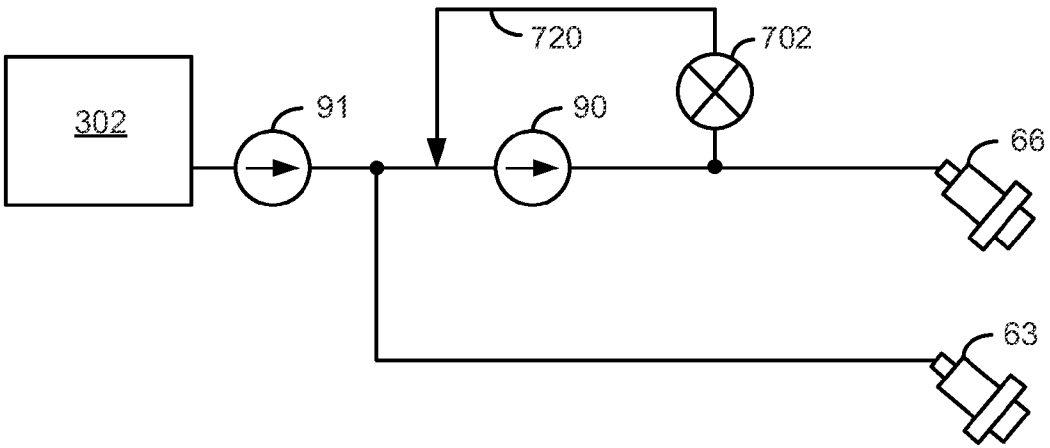
FIG. 7 is a schematic of another alternative example fuel system supplying fuel to an engine.
Figure 8A:
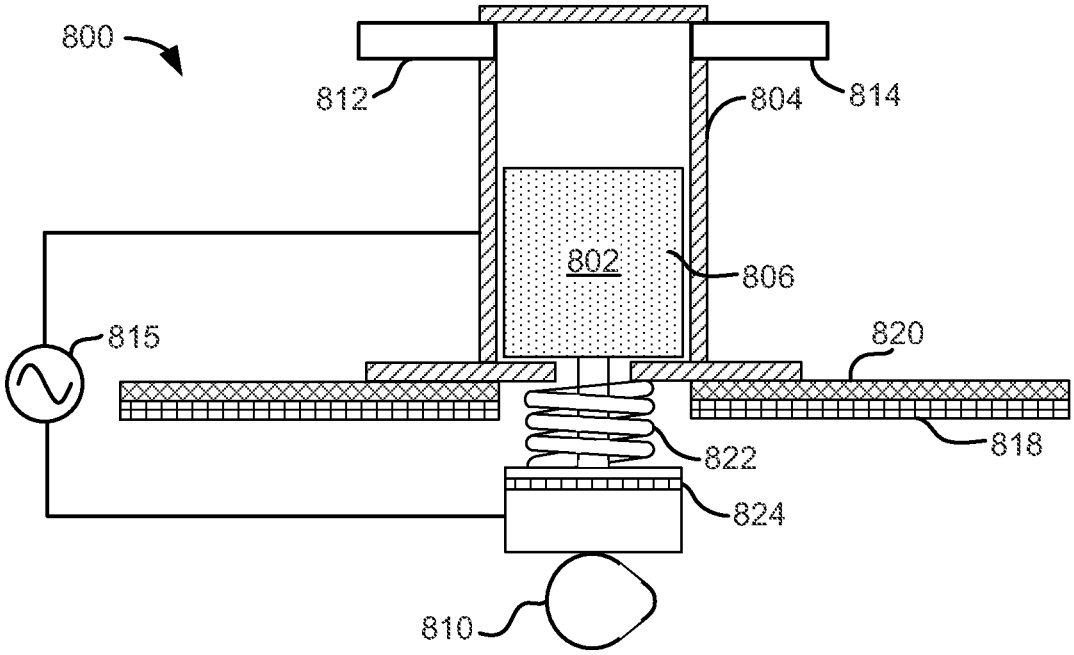
FIG. 8A is a schematic of an example fuel pump.
Figure 8B:
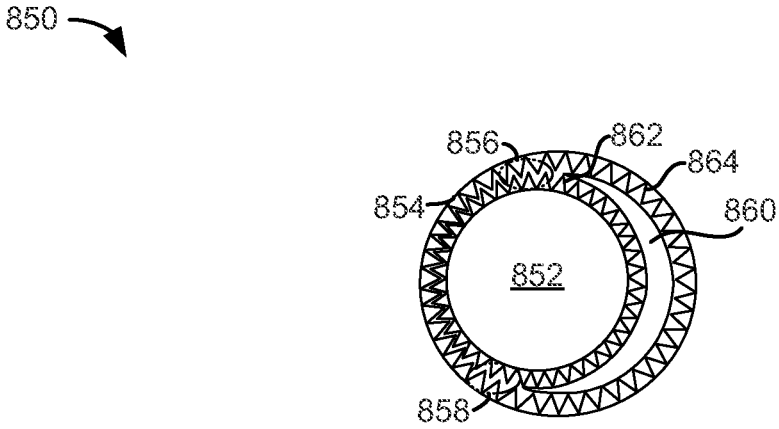
FIG. 8B is a schematic of an alternative example pump.

Referring now to FIG. 7, a schematic of another alternative example fuel system supplying fuel to an engine is shown. The fuel system of FIG. 7 may be incorporated with the system of FIG. 1 to supply fuel to the engine of FIG. 1. Components of FIG. 7 may be operated via the method of FIGS. 9-11.

Fuel system 700 is identical to fuel system 300 except fuel system 500 includes a fuel return valve 702 that returns fuel back to the inlet of fuel pump 90 when opened. The components of fuel system 700 common with components of fuel system 300 are numbered the same and operated as described in FIG. 3. Therefore, for the sake of brevity, the description of these components is omitted here and only new elements or components are described.

When return valve 702 is open, fuel can flow from the outlet of fuel pump 90 in the direction of the arrow of return line 720. Thus, valve 702 or fuel injector 66 can control the flow of fuel through fuel pump 90. Valve 702 allows fuel to flow through and lubricate fuel pump 90 without having to operate fuel injector 66. Consequently, fuel injector operation does not have to be adjusted in system 700 in order to lubricate fuel pump 90.

Referring now to FIG. 8A, a schematic of an example fuel pump is shown. Fuel pump 800 includes a piston 802 and a housing 804. Piston 802 includes a diamond like coating (DLC) 806 that can electrically insulate piston 802 from housing 804. However, if diamond like coating 806 degrades, there may be increased electrical conductivity between piston 802 and housing or cylinder 804. Piston 802 is driven via cam lobe 810 and pressurizes fuel in housing 804 thereby increasing fuel pressure. Spring 822 returns piston 802 to a lower position when cam lobe 810 is at a lower level. Electrical insulator 820 electrically insulates housing 804 from mounting surface 818. Electric power supply 815 supplies a voltage between piston 802 and cam lobe 810 so that current flows through piston 802 and housing 804 if diamond coating becomes degraded. Pumped fluid enters inlet port 812 and exits outlet port 814. Electrical insulator 824 electrically insulates spring 822 from cam lobe 810.

Referring now to FIG. 8B, an alternative example gear rotor pump is shown. Pump 850 includes a rotor 852 that may be mechanically driven via a crankshaft, transmission shaft, or other type of shaft. Rotor 852 includes teeth 862. Pump 850 includes an outer ring gear 854 with teeth 864. Teeth 862 engage teeth 864 when rotor 852 turns. Consequently, ring gear 854 is turned via rotor 852. Crescent 860 keeps ring gear 854 and rotor 852 aligned. Oil or other fluid may enter pump 850 via inlet port 858. Rotor teeth 852 and ring gear teeth 864 direct fluid to outlet port 856. Rotor teeth 852 may be coated with a diamond like coating to electrically insulate impeller 852 from ring gear 854. If the diamond like coating degrades, electrical conductivity between rotor 852 and ring gear 854 may be increased. Thus, the resistance between rotor 852 and ring gear 854 can be measured to determine pump degradation.

Thus, the system described in FIGS. 1-8B provides for a system for operating an fuel pump, comprising: an engine; a first fuel pump driven via the engine, the fuel pump including a motive force component and a second component; and a controller, the controller including instructions for controlling flow through the fuel pump responsive to an electrical property between the motive force component and the second component, the controller including further instructions for adjusting a fuel amount supplied to the engine via a second fuel pump responsive to an amount of fuel supplied to the engine via the first fuel pump. In this way, operation of a second fuel pump can be adjusted when degradation of a first fuel pump is detected so as to respond to a desired amount of engine torque even when one fuel pump is degraded. The system includes where the first fuel pump supplies fuel to a direct fuel injector. The system further comprises additional controller instructions to activate or deactivate a valve in response to the electrical property. In one example, the system includes where the electrical property is a resistance or a capacitance. The system also includes where the first fuel pump and the second fuel pump deliver two different types of fuel to the engine.

Figure 9:
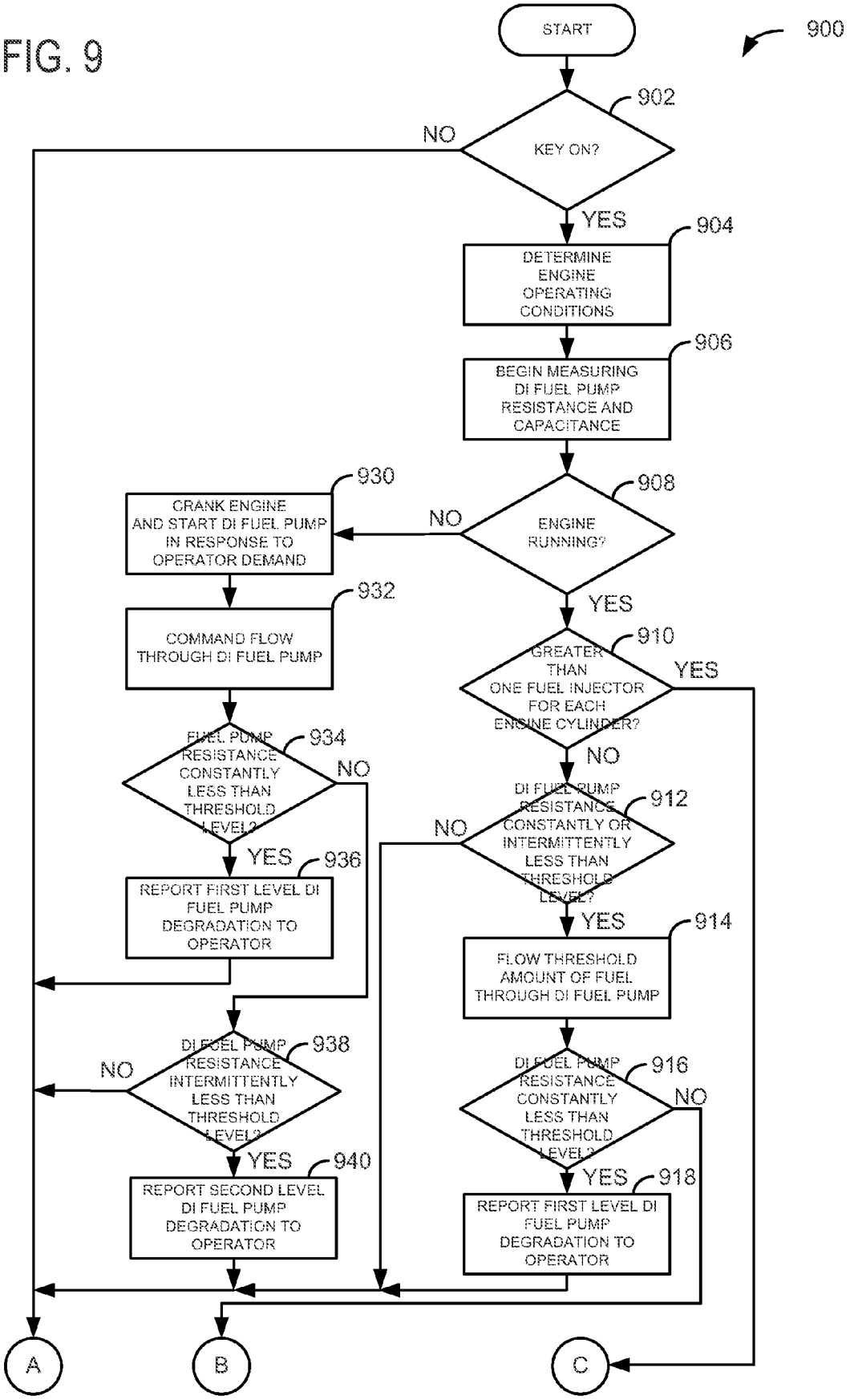
FIGS. 9-11 are a flowchart of an example method for operating a fuel pump.
Figure 10:
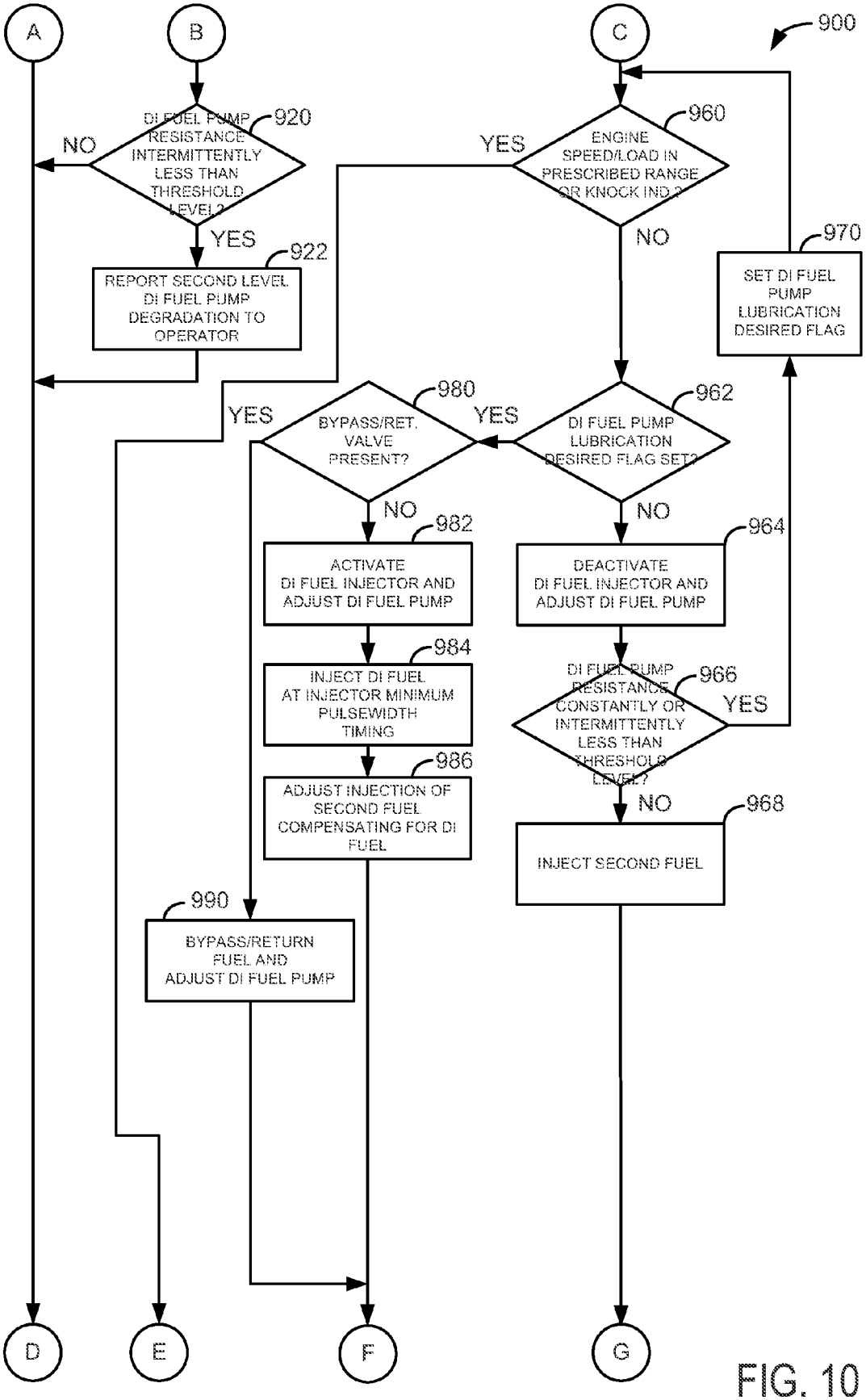
Figure 11:
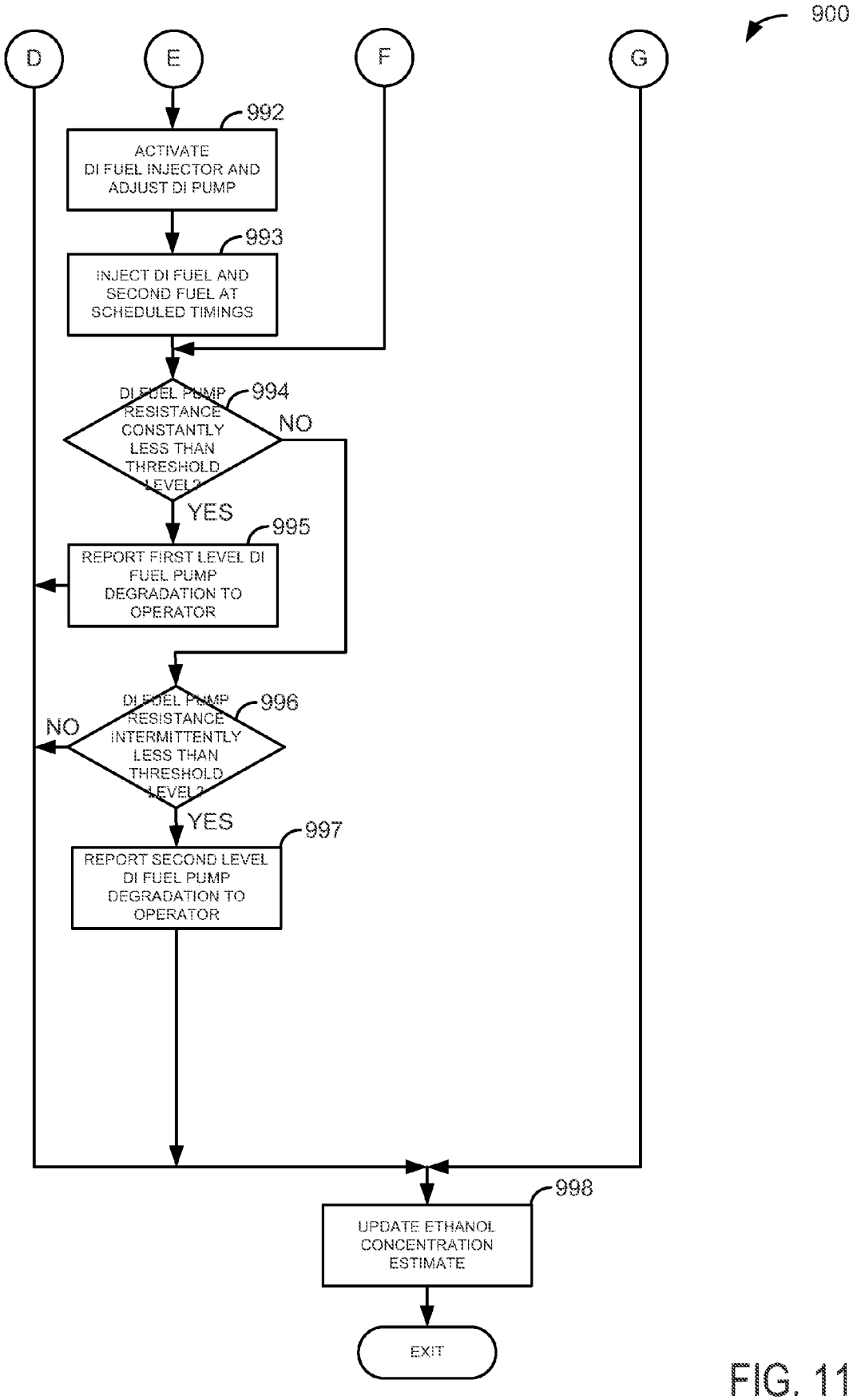

Referring now to FIGS. 9-11, a flowchart of an example method for operating a fuel pump is shown. The method of FIGS. 9-11 may be executed via instructions in controller 12. Further, the method of FIGS. 9-11 may be implemented in the system of FIG. 1. In addition, although method 900 describes a direct injection fuel pump, a port injection fuel pump may also be monitored and operated as described with regard to method 900.

At 902, method 900 judges whether or not the vehicle key is on or whether there is some other indication of imminent engine starting. If so, method 900 proceeds to 904. Otherwise, method 900 proceeds to 998 at FIG. 11.

At 904, method 900 determines engine operating conditions. Engine operating conditions may included but are not limited to engine speed, engine load, barometric pressure, battery voltage, fuel level, and fuel type. Method 900 proceeds to 906 after engine operating conditions are determined.

At 906, method 900 begins measuring resistance and/or capacitance of one or more direct injection (DI) fuel pumps (e.g., a fuel pump that supplies an injector delivering fuel directly into a cylinder). In one example, the DI fuel pumps may be as described in FIG. 8A or 8B and in a system as described in FIGS. 2-7. Controller 10 of FIG. 1 includes circuitry for determining the resistance and capacitance of DI pump 90. Method 900 proceeds to 908 after measuring resistance and capacitance of system fuel pumps.

At 908, method 900 judges whether or not the engine provided fuel by the DI fuel pump is running. In one example, the engine may be determined to be running or not based in a speed of the engine. Method 900 proceeds to 910 if it is determined that the engine is running. Otherwise, method 900 proceeds to 930.

At 910, method 900 judges whether or not there is more than one fuel injector delivering fuel to each cylinder of the engine. If so, method 900 proceeds to 960. Otherwise, method 900 proceeds to 912.

At 912, method 900 judges whether the direct injection fuel pump electrical resistance is constantly or intermittently less than a threshold level. Fuel pump electrical resistance may be a constantly low level when there is a high level of conductivity between the fuel pump piston and the fuel pump housing or cylinder. If a diamond like coating of the piston is degraded, there may be a high level of conductivity between the fuel pump piston and the fuel pump housing. An intermittent high level of conductivity between the piston and the fuel pump housing may be present when the piston is moving and in periodic contact with the fuel pump housing. Fuel pump resistance may be determined by applying a voltage between the piston and the fuel pump housing and monitoring current flow. Increased current flow indicates lower resistance and lower current flow indicates higher resistance. If the electrical resistance of the fuel pump is constant or intermittently less than a threshold level, method 900 proceeds to 914. Otherwise, method 900 proceeds to 998.

At 914, method 900 allows a threshold amount of fuel to flow through the DI fuel pump to lubricate the DI fuel pump. Fuel may flow through the DI fuel pump when a fuel injector, bypass valve, or fuel return valve is opened. In one example, the threshold fuel amount is based on a minimum injector opening time where fuel injector fuel delivery is repeatable. The fuel may also provide some level of electrical resistance between the fuel pump housing and the fuel pump piston. Method 900 proceeds to 916 after a threshold amount of fuel is flowing through the DI fuel pump.

At 916, method 900 judges whether or not the DI fuel pump electrical resistance is constantly less than a threshold level while fuel is flowing through the fuel pump. If DI fuel pump electrical resistance is less than a threshold level, method 900 proceeds to 918. Otherwise, method 900 proceeds to 920.

At 918, method 900 reports a first level of DI fuel pump degradation to an operator. In one example, the first level of DI fuel pump degradation may indicate a higher level of degradation as compared to a second level of DI fuel pump degradation. Method 900 proceeds to 998 after reporting a first level of degradation to an operator.

At 920, method 900 judges whether or not DI fuel pump electrical resistance is intermittently less than a threshold level. If DI fuel pump electrical resistance is intermittently less than a threshold level, method 900 proceeds to 922. Otherwise, method 900 proceeds to 998.

At 930, method 900 cranks the engine and starts flowing fuel through the DI fuel pump in response to an operator request. In one example, the DI fuel pump starts as the engine begins to rotate since the DI fuel pump is mechanically driven via the engine. Method 900 proceeds to 932 after engine cranking and DI fuel pump operation begin.

At 932, method 900 commands flow through the DI fuel pump. In one example, fuel pump flow can be adjusted by adjusting a valve of the DI fuel pump and/or another valve such as a fuel injector, fuel pump bypass valve, or fuel return valve. The DI fuel pump valve adjusts the volume of fluid pumped through the DI fuel pump whereas the fuel injector allows fuel to pass through the DI fuel pump so as to eliminate a fuel pump dead head condition. Method 900 proceeds to 934 after commanding flow through the fuel pump.

At 934, method 900 judges whether or not DI fuel pump electrical resistance is constantly less than a threshold level. A low electrical resistance can indicate contact between the DI fuel pump piston and the DI fuel pump housing. If method 900 judges that there is a constant low level of electrical resistance of the DI fuel pump between the fuel pump piston and the fuel pump housing, method 900 proceeds to 936. Otherwise, method 900 proceeds to 938.

At 936, method 900 reports a first level of DI fuel pump degradation to an operator. The report may be made via a light or a message on a message display. Method 900 proceeds to 998 after a first level of DI fuel pump degradation is reported to the operator.

At 938, method 900 judges whether or not the electrical resistance between the fuel pump piston and the fuel pump housing is intermittently less than a threshold level. If so, method 900 proceeds to 940. Otherwise, method 900 proceeds to 998. In this way, an intermittent low electrical resistance of a DI fuel pump may provide an early indication of fuel pump degradation prior to an indication based on a constant low electrical resistance of a DI fuel pump. Thus, DI fuel pump degradation may be reported in two modes. A first mode based on intermittent low electrical resistance of the fuel pump, and a second mode based on constant low electrical resistance of the fuel pump.

At 940, method 900 reports a second level of DI fuel pump degradation to the operator. The second level of DI fuel pump degradation may be reported via a message light or a message panel. Method 900 proceeds to 998 after the second level of DI fuel pump degradation is reported to the operator.

At 960, method 900 judges whether or not engine speed and load are in a prescribed range of engine speed and load or whether engine knock is indicated. If so, method 900 proceeds to 992. Otherwise, method 900 proceeds to 962. In other words, method 900 judges whether or not it is desirable to operate the engine with one or two active fuel injectors.

At 962, method 900 judges whether or not a fuel pump lubrication flag is set. A fuel pump lubrication flag may be used to start fuel flowing through the fuel pump so that the fuel provides lubrication to the fuel pump. In some examples, the fuel pump electrical resistance between the piston and the fuel pump housing can be increased via increasing fuel flow through the fuel pump. If the fuel pump lubrication flag is set, method 900 proceeds to 980. Otherwise, method 900 proceeds to 964.

At 964, method 900 deactivates the DI fuel injector and adjusts the DI fuel pump. The DI fuel pump may be adjusted by changing a position of a valve that determines a volume of fuel pumped via the DI fuel pump. In this way, fuel flow through the DI fuel pump is decreased when additional fuel pump lubrication is not requested. Method 900 proceeds to 966 after the DI fuel injector is deactivated.

At 966, method 900 judges whether or not the electrical resistance between the fuel pump piston and the fuel pump housing is constantly or intermittently less than a threshold level. If so, method 900 proceeds to 970. Otherwise, method 900 proceeds to 968.

At 970, method 900 sets a DI fuel pump lubrication desired flag. The fuel pump lubrication flag allows fuel to flow through the DI fuel pump when fuel pump electrical resistance is low so that the DI fuel pump may be lubricated. The DI fuel pump may be lubricated even when fuel injection via a single fuel injector is adequate to supply fuel to the engine. In this way, fuel pump lubrication can be ensured even when injection of fuel via the DI fuel pump is not required based on engine speed and load. Method 900 returns to 960 after the fuel pump lubrication flag is set.

At 968, method 900 injects a second fuel via a second injector and does not inject fuel via the DI fuel pump. Thus, fuel may be injected to a cylinder via one fuel injector while another fuel injector supplying fuel to the cylinder is deactivated. Method 900 proceeds to 998 after fuel is injected via the second injector.

At 980, method 900 judges whether or not to bypass or return fuel valves are present in the fuel system. If so, method 900 proceeds to 990. Otherwise, method 900 proceeds to 982. By ascertaining whether or not the fuel system includes a bypass or return valve, method 900 can judge whether to inject fuel to the engine, or alternatively return fuel to a fuel tank or inlet of the DI fuel pump to allow flow through the fuel pump.

At 982, method 900 activates a DI fuel injector and adjusts flow through the DI fuel pump. The fuel pump can be adjusted by increasing the volume of fuel pumped through the fuel pump. Thus, more fuel may be pumped through the fuel pump so that the fuel lubricates the space between the fuel pump piston and the fuel pump housing. Method 900 proceeds to 984 after the DI fuel injector is activated the DI fuel pump is adjusted.

At 984, method 900 injects fuel to the engine via the DI fuel injector. In one example, the fuel injected via the DI fuel injector is injected at a minimum fuel injector pulse width. The minimum fuel pulse width is a smallest injection timing where the amount of fuel injected is repeatable. The fuel may be injected at a minimum pulse width to conserve the fuel and increase the amount of time that the fuel pump may be lubricated via the fuel. Method 900 proceeds to 986 after fuel is scheduled to be injected via the DI fuel injector.

At 986, method 900 adjusts fuel injection of a second fuel via decreasing the amount of the second fuel injected to compensate for additional fuel being injected. In one example, the amount of the second fuel decreased via the second injector is related to the amount of fuel injected via the DI fuel injector. The amount of fuel injection decrease in the second fuel amount can be proportional to the amount of torque available from the engine via injecting the first fuel via the DI fuel injector. Method 900 proceeds to 994 after the fuel amount injected via the second fuel injector is adjusted.

At 990, method 900 bypasses or returns fuel to a fuel tank or the input of the DI fuel pump. When fuel is bypassed to the inlet of the fuel pump or returned to a fuel tank fuel flow through the DI fuel pump can be increased without injecting fuel to the engine via the DI fuel pump. The fuel may be returned to the DI fuel pump inlet or a fuel tank via opening a valve (e.g., 402 of FIG. 4 or 502 of FIG. 5). Method 900 proceeds to 994 after the bypass or return valve is opened.

At 992, method 900 activates a DI fuel injector and adjusts a DI fuel pump. The DI fuel injector and the DI fuel pump may be activated at higher engine speeds and loads where an increased amount of the first fuel or fluid is desired. In one example, the first fluid may be water, alcohol, a mixture of gasoline and alcohol, or a mixture of water and alcohol. By activating the DI fuel injector, it may be possible to increase lubrication of the DI fuel pump. The DI fuel pump can also be adjusted via adjusting a position of a valve of the DI fuel pump. In one example, the DI fuel pump valve can be adjusted to increase the volume of fuel pumped via the DI fuel pump. It should also be noted that the amount of fuel flowing through the fuel pump may be adjusted in response to the concentration of alcohol in the fuel flowing through the DI fuel pump. In one example, the flow rate through the fuel pump can be increased to a higher level when a concentration of alcohol is higher. Method 900 proceeds to 993 after the DI fuel injector and DI fuel pump are activated.

At 993, fuel is injected via the DI fuel injector and the second injector at scheduled timings. The scheduled timings may be based on engine speed and load. Further, the timing of DI fuel injection and of the second fuel can be further adjusted in response to an oxygen sensor output. Method 900 proceeds to 994 after DI fuel is injected.

At 994, method 900 judges whether or not DI fuel pump electrical resistance between the fuel pump housing and the fuel pump piston is constantly less than a threshold resistance. If so, method 900 proceeds to 995. Otherwise, method 900 proceeds to 996.

At 995, method 900 reports a first level of fuel pump degradation to an operator. The fuel pump degradation may be reported via an indicator light or a message display. Method 900 proceeds to 998 after fuel pump degradation is reported.

At 996, method 900 judges whether or not fuel pump electrical resistance is intermittently less than a threshold level. In other words, method 900 can monitor the electrical resistance of the fuel pump for instances of low electrical resistance between the fuel pump piston and the fuel pump housing or cylinder wall. If the electrical resistance of the fuel pump is intermittently less than a threshold amount, method 900 proceeds to 997. Otherwise, method 900 proceeds to 998.

At 997, method 900 reports a second level of DI fuel pump degradation to the operator. Degradation may be indicated to the operator via an indicator light or a message display. Method 900 proceeds to 998 after degradation is reported to the operator.

At 998, method 900 updates an ethanol concentration of fuel in response to a level of capacitance between a DI fuel pump piston and a cylinder wall or pump housing. In one example, an AC voltage may be applied between the piston and the cylinder wall to measure the electrical capacitance of the DI fuel pump. The voltage that develops from the piston to the cylinder wall may reflect the capacitance of the DI fuel pump. In another example, a voltage may be applied from the piston to the cylinder wall and the rise time of the voltage of the fuel pump may be measured to determine fuel pump capacitance. Once fuel pump capacitance is determined, the capacitance can be compared to a table of empirically determined fuel pump capacitance levels to determine the concentration of alcohol in the fuel passing through the fuel pump. The concentration of alcohol in fuel injected to the engine is updated based on the capacitance of the DI fuel pump. Method 900 proceeds to exit after the concentration of alcohol in fuel injected to the engine is updated.

In this way, the method of FIGS. 9-11 provides for diagnosing operation of a fuel pump based on an electrical property of the fuel pump, even when the fuel pump is solely mechanically driven. It should also be mentioned that the method of FIGS. 9-11 is applicable to electrically or hydraulically driven pumps. Further, the method of FIGS. 9-11 provides for compensating fuel injection timing in response to fuel pump degradation. Further still, the method of FIGS. 9-11 provides a way of increasing fuel pump lubrication in response to fuel pump degradation. Thus, an early warning may be provided to an operator when a DLC coating of a pump degrades so that the pump may be serviced before the pump degrades further. By increasing fuel pump pressure when the pump is not delivering fuel to the engine, fuel pump degradation may be reduce until the fuel pump can be serviced.

Thus, the method of FIGS. 9-11 provides for a method for operating a fuel pump, comprising: diagnosing operation of a fuel pump driven solely mechanically in response to an electrical property between a motive force component of the fuel pump and a stationary component of the fuel pump. In this way, a mechanically driven pump can be diagnosed via an electrical property of the pump. A resistance level between a piston and a housing, for example. The method includes where the fuel pump is driven via an engine camshaft or crankshaft. The method also includes where the electrical property is a resistance or a capacitance. In one example, the method includes where the motive force component is a piston or an impeller. The method also includes where the stationary component is a cylinder wall or a pump housing. The method further comprises providing an electric insulator between the motive force component and the stationary component and indicating fuel pump degradation in response to an electrical resistance of the fuel pump less than a threshold value. The method further comprises adjusting fuel flow through the fuel pump in response to an electrical resistance of the fuel pump less than a threshold value.

In another example, the method of FIGS. 9-11 provides for a method for operating a fuel pump, comprising: reducing flow through the fuel pump in response to an engine operating condition; and increasing a fuel flow through a fuel pump via adjusting a position of a valve external to the fuel pump, the fuel flow increased in response to an electrical property between a motive force component of the fuel pump and a second component of the fuel pump. In this way, flow through a fuel pump can be adjusted to control fuel pump lubrication. The method includes where the valve is a fuel injector or a fuel return valve. The method also includes where flow through the fuel pump is reduced via stopping flow through a fuel injector. The method further comprises adjusting a flow rate through the fuel pump responsive to a type of fuel flowing through the fuel pump. The method also includes where a flow rate through the fuel pump is increased by a first amount when a fuel flowing through the fuel pump comprises a first concentration of alcohol, and where the flow rate through the fuel pump is increased by a second amount when the fuel flowing through the fuel pump comprises a second concentration of alcohol, the second amount greater than the first amount and the second concentration greater than the first concentration. In one example, the method includes where the second component is a stationary component. The method includes where the stationary component is a cylinder wall or a housing of the fuel pump. The method also includes where fuel flow through the fuel pump is substantially stopped in response to the engine operating condition and where the motive force component is moving.

The method of FIGS. 9-11 also provides for a method for determining alcohol content of a fuel, comprising: adjusting an estimate of alcohol in a fuel in response to an electrical capacitance of a fuel pump. In one example, the electrical capacitance of the fuel pump is measure while the pump is rotating. Further, the capacitance of the fuel pump may be measured between a piston and a cylinder wall of the fuel pump. Thus, an apparatus for determining alcohol content of a fuel includes a fuel pump and a controller, the controller including instructions for determining electrical capacitance of a fuel pump and adjusting an estimate of alcohol in a fuel in response to the capacitance. In other examples, the fuel pump may be a rotor type fuel pump. Further, the fuel pumps may include a DLC coating to electrically insulate one fuel pump component from another fuel pump component. And, the controller can include instructions for measuring fuel pump electrical capacitance across the DLC coating.

As will be appreciated by one of ordinary skill in the art, routines described in FIGS. 9-11 may represent one or more of any number of processing strategies such as event-driven, interrupt-driven, multi-tasking, multi-threading, and the like. As such, various steps or functions illustrated may be performed in the sequence illustrated, in parallel, or in some cases omitted. Likewise, the order of processing is not necessarily required to achieve the objects, features, and advantages described herein, but is provided for ease of illustration and description. Although not explicitly illustrated, one of ordinary skill in the art will recognize that one or more of the illustrated steps or functions may be repeatedly performed depending on the particular strategy being used.

This concludes the description. The reading of it by those skilled in the art would bring to mind many alterations and modifications without departing from the spirit and the scope of the description. For example, I3, I4, I5, V6, V8, V10, and V12 engines operating in natural gas, gasoline, diesel, or alternative fuel configurations could use the present description to advantage.

The invention claimed is:

1. A method for operating a fuel pump, comprising:

driving a motive force component of the fuel pump for supplying fuel solely mechanically;

displacing the fuel from a stationary component of the fuel pump with the motive force component; wherein the stationary component is used to house the motive force component;

controlling a quantity of the fuel supplied with a controller;

determining the operation of the fuel pump with the controller in response to an electrical resistance measured within the fuel pump directly between the motive force component and the stationary component of the fuel pump;

wherein an electric insulator is provided on an exterior surface of the motive force component and radially adjacent an interior surface of the stationary component; and indicating, via the controller, degradation of the fuel pump in response to the electrical resistance measured through the insulator of the fuel pump being less than a threshold value.

2. The method of claim 1, where the fuel pump is driven via an engine camshaft or crankshaft.

3. The method of claim 1, further comprising adjusting the quantity of fuel flow through the fuel pump in response to the electrical resistance of the fuel pump being less than the threshold value.

4. A method for operating a fuel pump of an engine, comprising:

driving a motive force component of the fuel pump for supplying fuel to the engine solely mechanically by the engine;

displacing the fuel from a second component of the fuel pump with the motive force component; wherein the second component is used to house the motive force component;

controlling flow through the fuel pump with a controller;

reducing the flow through the fuel pump with the controller in response to an engine operating condition; and increasing the fuel flow through the fuel pump by adjusting a position of a valve external to the fuel pump, in response to an electrical resistance measured within the fuel pump directly between the motive force component and the second component of the fuel pump, wherein an electric insulator is provided on an exterior surface of the motive force component and radially adjacent an interior surface of the second component; and indicating, via the controller, degradation of the fuel pump in response to the electrical resistance measured through the insulator of the fuel pump being less than a threshold value.

5. The method of claim 4, where the valve is a fuel injector or a fuel return valve.

6. The method of claim 5, where the flow through the fuel pump is reduced via stopping flow through a fuel injector.

7. The method of claim 5, further comprising adjusting a flow rate through the fuel pump in response to a type of fuel flowing through the fuel pump.

8. The method of claim 7, where the flow rate through the fuel pump is increased by a first amount when the fuel flowing through the fuel pump comprises a first concentration of alcohol, and where the flow rate through the fuel pump is increased by a second amount when the fuel flowing through the fuel pump comprises a second concentration of alcohol, the second amount greater than the first amount and the second concentration of alcohol is greater than the first concentration of alcohol.

9. The method of claim 4, where the fuel flow through the fuel pump is substantially stopped in response to the engine operating condition and where the motive force component is moving.

10. A system, comprising:

an engine;

a first fuel pump driven via the engine, the first fuel pump including a motive force component for supplying fuel to the engine from a second component, wherein the second component is used to house the motive force component;

an electric insulator having an initial thickness, provided on an exterior surface of the motive force component and located radially adjacent an interior surface of the second component;

a controller that controls an amount of the fuel supplied to the engine via the first fuel pump, a second fuel pump; wherein the controller controls a flow through the first fuel pump based on an electrical property measured within the first fuel pump through the motive force component, the electric insulator and the second component, wherein operation of the first fuel pump causes the electric insulator to degrade over time and the measured electrical property is indicative of the present thickness of the electric insulator, wherein the controller indicates degradation of the first fuel pump in response to the measured electrical property being less than a threshold value; and wherein the controller adjusts an amount of fuel supplied to the engine with the second fuel pump in response to the amount of fuel supplied to the engine via the first fuel pump.

11. The system of claim 10, where the first fuel pump supplies the fuel to a direct fuel injector.

12. The system of claim 10, further comprising a valve; wherein the controller activates or deactivates the valve in response to the measured electrical property.

13. The system of claim 12, where the measured electrical property is a resistance or a capacitance.

14. The system of claim 10, where the first fuel pump and the second fuel pump deliver two different types of fuel to the engine.

* * * * *